US009597889B2

(12) United States Patent
Shimizu et al.

(10) Patent No.: US 9,597,889 B2
(45) Date of Patent: Mar. 21, 2017

(54) LIQUID HEATING APPARATUS AND IMAGE FORMING APPARATUS

(71) Applicants: Takeshi Shimizu, Kanagawa (JP); Tsuneo Maki, Kanagawa (JP)

(72) Inventors: Takeshi Shimizu, Kanagawa (JP); Tsuneo Maki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/041,350

(22) Filed: Feb. 11, 2016

(65) Prior Publication Data

US 2016/0271964 A1 Sep. 22, 2016

(30) Foreign Application Priority Data

Mar. 16, 2015 (JP) ..... 2015-052170

(51) Int. Cl.
*B41J 2/175* (2006.01)

(52) U.S. Cl.
CPC ..... *B41J 2/17593* (2013.01); *B41J 2/175* (2013.01); *B41J 2/17513* (2013.01)

(58) Field of Classification Search
CPC .... B41J 2/175; B41J 2/17503; B41J 2/17506; B41J 2/17509; B41J 2/17593; B41J 2/19
See application file for complete search history.

(56) References Cited

U.S. PATENT DOCUMENTS 4,814,786 A * 3/1989 Hoisington ..... B41J 2/17593 347/88
5,105,209 A * 4/1992 Koto ..... B41J 2/14282 347/70
5,557,305 A * 9/1996 Hine ..... B41J 2/1652 347/17
6,213,596 B1 * 4/2001 Nowell, Jr. ..... B41J 2/17503 347/85
6,854,834 B2 * 2/2005 Hara ..... B41J 2/17503 347/85
7,360,882 B2 * 4/2008 Ikeda ..... B41J 2/19 347/6
8,016,375 B2 9/2011 Katoh
8,308,252 B2 * 11/2012 Shimoda ..... B41J 2/175 347/19
8,313,183 B2 * 11/2012 Platt ..... B41J 2/17593 347/88

FOREIGN PATENT DOCUMENTS

JP 2009-214307 9/2009
JP 2013-220625 10/2013

* cited by examiner

*Primary Examiner* — Anh T. N. Vo
(74) *Attorney, Agent, or Firm* — Cooper & Dunham LLP

(57) ABSTRACT

A liquid heating apparatus for heating a liquid that is supplied to a liquid droplet ejection head is provided. The liquid heating apparatus includes a liquid chamber unit configured to be disposed on the supply route of the liquid and to temporarily store the liquid, and a temperature-adjusting flow path unit configured to heat the liquid supplied from the liquid chamber unit.

3 Claims, 2 Drawing Sheets

LIQUID HEATING APPARATUS AND IMAGE FORMING APPARATUS

BACKGROUND OF THE INVENTION

1. Field of the Invention

The present invention relates to a liquid heating apparatus and an image forming apparatus.

2. Description of the Related Art

As an image forming apparatus including a printer, a fax machine, a copy machine, a plotter, a multifunction peripheral with combined functions thereof, and the like, an inkjet recording apparatus, for example, that uses a liquid ejection recording method, in which a recording head is used for ejecting an ink droplet, is known. In the image forming apparatus using the liquid ejection recording method, image forming ("recording", "printing", etc., are used as synonyms of "image forming") is performed by ejecting an ink droplet from a recording head onto a conveyed sheet. There are a serial type image forming apparatus and a line type image forming apparatus. In the serial type image forming apparatus, an image is formed by having droplets ejected while the recording head is moving in a main-scanning direction, and in the line type image forming apparatus, an image is formed by having droplets ejected while the recording head is stationary.

It should be noted that, in the present application, "image forming apparatus" refers to an apparatus in which image forming is performed by ejecting ink onto a medium such as a paper medium, a string medium, a fiber medium, a towel medium, a leather medium, a metal medium, a plastic medium, a glass medium, a wood medium, a ceramic medium, etc., (including a simple liquid ejection apparatus). Further, "image forming" means not only that a meaningful image such as a character or a figure is being attached to the medium but also that a meaningless image such as a pattern is being attached to the medium (droplets are simply being ejected onto the medium). Further, "ink" is not limited to something referred to as ink, but may be used as a generic term for any kind of liquid that can be used to form images such as those referred to as recording liquid, fixing processing solution, liquid. Further, "sheet" is not limited to materials such as paper, but includes an overhead projector (OHP) sheet or a cloth, or materials on which ink droplets can be attached, and may be used as a generic term for things referred to as a recording medium, a recording paper, or a recording sheet, etc.

As a liquid ejection head (liquid droplet ejection head) used for a recording head, piezoelectric heads and thermal heads are known. In piezoelectric heads, a volume of a liquid chamber is changed by a moving diaphragm moved by a piezoelectric actuator, pressure in the liquid chamber is increased, and thus, liquid droplets are ejected. In thermal heads, the pressure in the liquid chamber is increased by bubbles generated by heat of a heating element, and thus, liquid droplets are ejected.

In the image forming apparatuses of a liquid ejection method as described above, there is a kind of ink that has high viscosity at room temperature. When an ink with high viscosity is used, in many cases, the ink is heated in order to reduce the viscosity in advance before the ink is supplied to an inkjet head through a supply tube. A technique is known in which preliminary heating is provided for the ink by disposing a liquid heating apparatus (preliminary heating apparatus) in the middle of an ink supply path from an ink tank to the inkjet head.

As an image forming apparatus with this kind of liquid heating apparatus, conventionally, image forming apparatuses described in Patent Documents 1 and 2 are known. The image forming apparatus described in Patent Document 1 includes a recording head for ejecting ink, an ink tank for storing the ink, and a flexible supply tube disposed in between the ink tank and the recording head.

The above supply tube includes an internal tube which forms a first flow path in which supplied ink flows from the ink tank to the recording head, and an external tube which is disposed around the internal tube. A second flow path is formed between the internal tube and the external tube. In the second flow path, temperature control liquid flows in order to control temperature of the ink flowing in the first flow path.

In contrast, a liquid ejecting apparatus described in Patent Document 2 includes a recording head for ejecting ink onto a sheet and an ink heating apparatus that is connected to the recording head via an ink flow path and is capable of adjusting temperature. The ink flow path is provided in order to allow the ink to flow from an upstream ink cartridge to a downstream recording head, and to supply the ink to the recording head. The ink flow path is arranged in such a way that it goes through a housing space that houses the recording head.

SUMMARY OF INVENTION

Technical Problem

However, in the image forming apparatus described in Patent Document 1, flow amount change of the ink tends to create temperature fluctuations in the ink because the temperature of the ink is being adjusted in the middle of the flow path from the ink tank to the recording head.

Alternatively, in the liquid ejection apparatus described in Patent Document 2, it takes a long time from when a printer is turned on to when the recording head becomes ready for ejecting ink because of the high heat capacity of the ink in the ink cartridge.

Further, similar to Patent Document 1, flow amount change of the ink tends to create temperature fluctuations in the ink because the ink heating apparatus is disposed in the middle of the ink supply path from the ink cartridge to the recording head. Further, due to the temperature fluctuation of the ink, weight fluctuation of the ejected ink droplet occurs when the ink is ejected from the recording head, which creates an unresolved problem of dot-diameter fluctuation.

In view of the above, it is an object of the present invention to provide a liquid heating apparatus that has a simple configuration capable of reducing the time from the power ON to the start of liquid ejection and reducing the fluctuation of liquid heating temperature.

CITATION LIST

Patent Document

[Patent Document 1] Japanese Laid-Open Patent Application No. 2009-214307

[Patent Document 2] Japanese Laid-Open Patent Application No. 2013-220625

SUMMARY OF THE INVENTION

The present invention provides a liquid heating apparatus for heating liquid to be supplied to a liquid droplet ejection head. The liquid heating apparatus includes a liquid chamber, disposed on a liquid supply route for the liquid, configured to temporarily store the liquid, and a temperature-adjusting flow path unit configured to heat the liquid supplied from the liquid chamber.

According to the present invention, it becomes possible to reduce the time from the power ON to the start of liquid ejection and to reduce the fluctuation of liquid heating temperature.

Other objects, features and advantages of the present invention will become more apparent from the following detailed description when read in conjunction with the accompanying drawings.

DETAILED DESCRIPTION OF THE PREFERRED EMBODIMENTS

Figure 1:
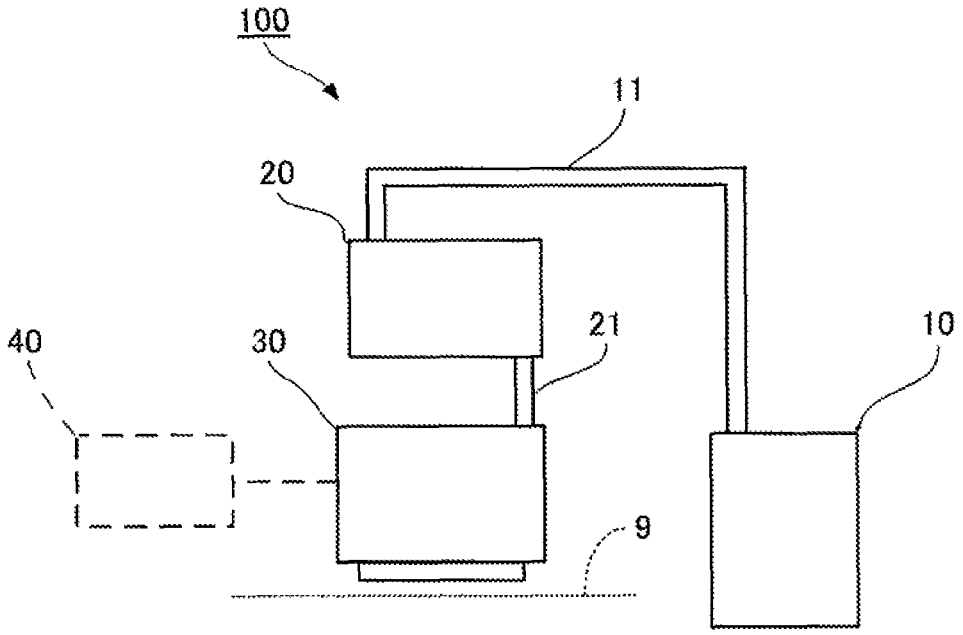
FIG. 1 is a block diagram illustrating a schematic configuration of an image forming apparatus that uses a liquid heating apparatus according to a first embodiment of the present invention.

A liquid heating apparatus according to a first embodiment of the present invention and an image forming apparatus which uses the liquid heating apparatus will be described with reference to the drawings. FIG. 1 is a block diagram illustrating a schematic configuration of an image forming apparatus that uses a liquid heating apparatus according to a first embodiment of the present invention.

In FIG. 1, as an example, an inkjet-type printer 100 (hereinafter, "printer") is shown illustrating an embodiment of an image forming apparatus. The printer 100 shown in FIG. 1 includes an ink tank 10, an ink heating apparatus 20 as a liquid heating apparatus, an ink ejection head 30 as a liquid droplet ejection head, and a drive unit 40.

The ink tank 10 has a volume in which a predetermined amount of liquid (hereinafter, "ink") can be stored. The ink tank 10 conveys the ink by using, for example, the hydraulic head between a nozzle surface of the ink ejection head 30 and a liquid surface of the ink tank 10. It should be noted that the conveyance of ink is not limited to the use of the hydraulic head.

The ink tank 10 and the ink heating apparatus 20 are connected via a first supply tube 11, and the ink heating apparatus 20 and the ink ejection head 30 are connected via a second supply tube 21.

In other words, the ink stored in the ink tank 10 is supplied to the ink heating apparatus 20 via the supply tube 11. Further, the ink is heated to a predetermined temperature in the ink heating apparatus 20 and supplied to the ink ejection head 30 via the supply tube 21. Further, the ink is ejected from the ink ejection head 30 onto a recording medium (sheet) 9 based on a drive signal transmitted in a timely manner from the drive unit 40.

Figure 2:
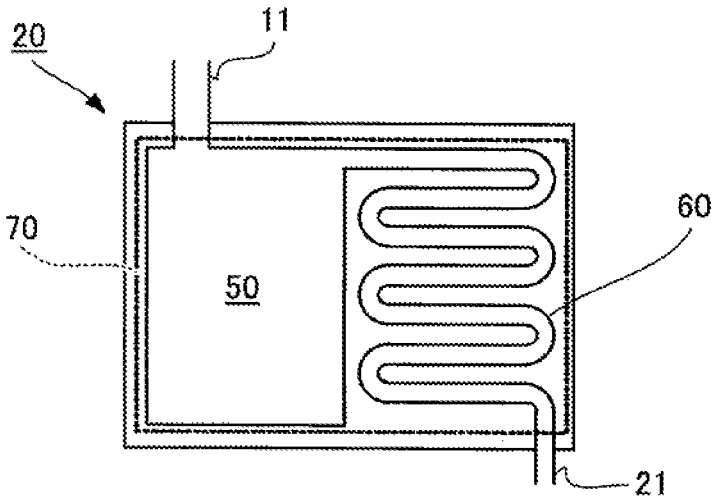
FIG. 2 is a piping diagram illustrating the configuration of the liquid heating apparatus.

FIG. 2 is a block diagram illustrating a schematic configuration of the ink heating apparatus 20. The ink heating apparatus 20 is an apparatus for heating the ink to be supplied to the ink ejection head 30, and includes a liquid chamber 50, a temperature-adjusting flow path unit 60, and a heater 70. In other words, the liquid chamber 50 and the temperature-adjusting flow path unit 60 are disposed on the supply route of the ink that is supplied to the ink ejection head 30.

The liquid chamber 50 according to the present embodiment is used for temporarily storing the ink supplied from the ink tank 10, and has a predetermined volume in order to reduce fluctuations in ink temperature caused by the flow amount change of the ink that is supplied to the ink ejection head 30.

The temperature-adjusting flow path unit 60 is used to heat the ink flowing in the temperature-adjusting flow path unit 60 and has a predetermined length by having a serpentine shape. It should be noted that the temperature-adjusting flow path unit 60 is not limited to having a serpentine shape, but it may have, for example, a spiral shape.

In the present embodiment, the liquid chamber 50 is disposed upstream of the ink ejection head 30 in a supplying direction and the temperature-adjusting flow path unit 60 is disposed downstream of the liquid chamber unit 50. The heater 70 heats the ink flowing in the liquid chamber 50 and the temperature-adjusting flow path unit 60.

Figure 3:
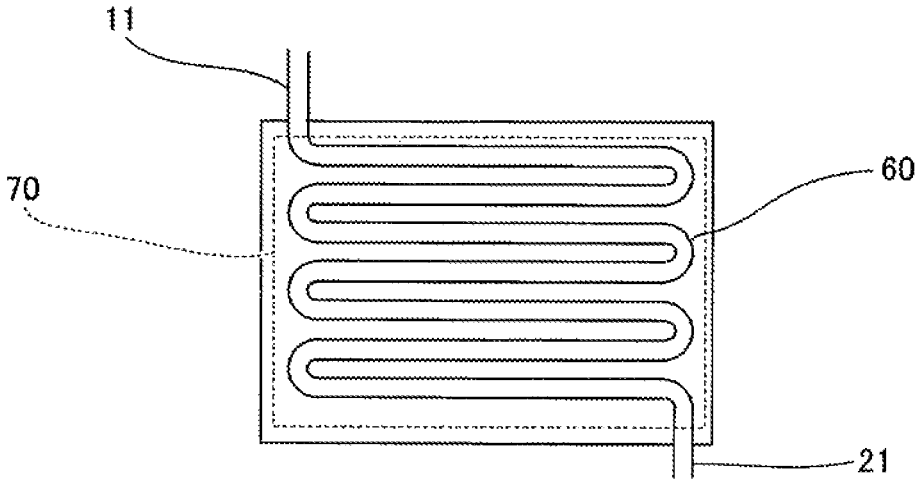
FIG. 3 is a piping diagram illustrating an example configuration of the liquid heating apparatus in which the temperature-adjusting flow path unit is formed to have an increased length.

FIG. 3 is a piping diagram illustrating a configuration of the liquid heating apparatus based on an assumption that only the temperature-adjusting flow path unit 60 is formed to have a long length. It should be noted that the same reference numbers are given to the units which have already been described in FIGS. 1 and 2, and the descriptions may be omitted. In order to increase transfer efficiency of the heat from the heater 70, the temperature-adjusting flow path unit 60 may be formed to maximize its length as shown in FIG. 3. However, increasing the length of the temperature-adjusting flow path unit 60 will lead to pressure loss in the temperature-adjusting flow path unit 60.

If the pressure loss is increased, when the ink is supplied by using the hydraulic head as described above, ejection failure may occur due to the ink supply shortage caused by the pressure loss when large amount of ink is ejected from the ink ejection head 30.

Therefore, in the present embodiment, in order to keep the pressure loss to a level equal to or below an allowable level, the liquid chamber 50 and the temperature-adjusting flow path unit 60 are combined to form the ink heating apparatus 20.

As a result, the volume of the liquid chamber 50 and the volume of the temperature-adjusting flow path unit 60 are set as follows. As described above, in order to improve the heat transfer efficiency, it is desirable to maximize the length of the temperature-adjusting flow path unit 60. Therefore, the volume of the temperature-adjusting flow path unit 60 is set as maximum volume A ml, which is derived from the allowable pressure loss.

On the other hand, the volume of the liquid chamber 50 is set as equal to or greater than B*C−A ml, where assumed maximum ink ejection amount per unit time is B ml/min, and required time for the ink in the ink heating apparatus 20 to be heated to a predetermined temperature is C min. Specifically, the setting is as follows.

According to calculation results, the volume of the temperature-adjusting flow path unit 60 is 1 ml which is derived from the allowable pressure loss. Further, it is assumed that the maximum ejection amount per unit time is 5 ml/min, and the required time for the ink in the ink heating apparatus 20 to be heated to the predetermined temperature is 0.5 min. In this case, the volume of the liquid chamber 50 may be 1.5 ml or more, and the volume of the entire ink heating apparatus 20 may be 2.5 ml or more. It should be noted that, it depends on the viscosity of the ink to be used, but it is desirable to make the inner diameter of the supplying tube about ϕ mm in the case of typical UV-curable ink. It should be noted that the combined flow path volume of the liquid chamber 50 and the temperature-adjusting flow path unit 60 is equal to or greater than the product of the maximum ejection amount of the ink ejection head 30 and the ink heating time.

According to the printer 100 described above, the following effects can be obtained. Because the liquid chamber 50 having a predetermined volume is disposed on the ink supplying route, it is possible to reduce fluctuations in ink temperature due to the ink flow amount change. Further, the volume of the temperature-adjusting flow path unit 60 can be maximized based on the allowable pressure loss. Therefore, it is possible to reduce the time from power ON to the start of liquid ejection and to reduce the mass fluctuation of the ink droplet.

The present invention is not limited to the specifically described embodiments, and variations and modifications may be made without departing from the scope of the present invention.

The present application is based on and claims the benefit of priority of Japanese Priority Application No. 2015-052170 filed on Mar. 16, 2015, the entire contents of which are hereby incorporated herein by reference.

What is claimed is:

1. A liquid heating apparatus for heating a liquid that is supplied in a liquid supply direction through a supply route to a liquid droplet ejection head, the liquid heating apparatus comprising:

a liquid chamber disposed upstream of the liquid ejection head in the liquid supply direction and disposed on the supply route of the liquid and configured to temporarily store the liquid supplied from a liquid tank;

a temperature-adjusting flow path disposed downstream of the liquid chamber in the liquid supply direction, the temperature-adjusting flow path including a predetermined length having a serpentine shape configured to heat the liquid supplied from the liquid chamber, the liquid flowing in the liquid supply direction through the predetermined length having the serpentine shape from one end of the predetermined length having the serpentine shape to the other end of the predetermined length having the serpentine shape;

a housing to house the liquid chamber and the temperature-adjusting flow path; and a heater surrounding the liquid chamber and surrounding the temperature-adjusting flow path, to heat both of (i) the liquid chamber and (ii) the temperature-adjusting flow path including the predetermined length having the serpentine shape through which the liquid flows from one end of the predetermined length having the serpentine shape to the other end of the predetermined length having the serpentine shape.

2. The liquid heating apparatus according to claim 1, wherein a combined flow path volume of the liquid chamber and the temperature-adjusting flow path is equal to or greater than a product of a maximum ejection flow amount of the liquid droplet ejection head and time for heating the liquid.

3. An image forming apparatus comprising: the liquid heating apparatus according to claim 1.

* * * * *